United States Patent [19]

Beck et al.

[11] 4,406,104

[45] Sep. 27, 1983

[54] SUSPENDED CEILING WALL ANGLE

[75] Inventors: Martin J. Beck, Boxford; George F. W. Boesel, Canton, both of Mass.

[73] Assignee: Armstrong World Industries, Inc., Lancaster, Pa.

[21] Appl. No.: 246,069

[22] Filed: Mar. 20, 1981

[51] Int. Cl.[3] ..... E04B 1/00

[52] U.S. Cl. ..... 52/283; 52/484; 52/732

[58] Field of Search ..... 52/283, 484, 732, 666,

[56] References Cited

U.S. PATENT DOCUMENTS 2,710,679 6/1955 Bibb et al. ..... 52/484 X 3,386,220 6/1968 Staats ..... 52/484 X

*Primary Examiner*—Carl D. Friedman

[57] ABSTRACT

The conventional inverted T ceiling runner structure is used as a wall angle molding for a suspended ceiling system. Appropriate spacing means are utilized adjacent the vertical web of the inverted T runner to space the vertical web from a vertical wall so that the runner may be mounted in position with its horizontal flanges in a horizontal plane perpendicular to the wall.

1 Claim, 3 Drawing Figures

SUSPENDED CEILING WALL ANGLE

BACKGROUND OF THE INVENTION

1. Field of the Invention

The invention is directed to a wall angle molding for a suspended ceiling and, more particularly, to an inverted T-shaped wall angle molding.

2. Description of the Prior Art

In a conventional suspended ceiling system the wall angle molding is usually an L-shaped metal molding with the upright leg of the L placed adjacent the wall and nailed thereto and with the horizontal leg of the L forming the horizontal flange for holding the edge of ceiling boards in position adjacent the wall.

SUMMARY OF THE INVENTION

The invention is directed to the use of an inverted T-shaped molding being used as a wall angle molding for a suspended ceiling system. Appropriate spacer means are positioned adjacent the vertical web of the inverted T runner so that nails passing through the vertical web may pass through the spacer means into the wall to mount the spacer means with its vertical web parallel with the plane of the wall. This then places the horizontal flanges of the inverted T-shaped runner in a horizontal plane parallel with the plane of the floor of the room receiving the suspended ceiling system.

DESCRIPTION OF THE PREFERRED EMBODIMENT

Figure 1:
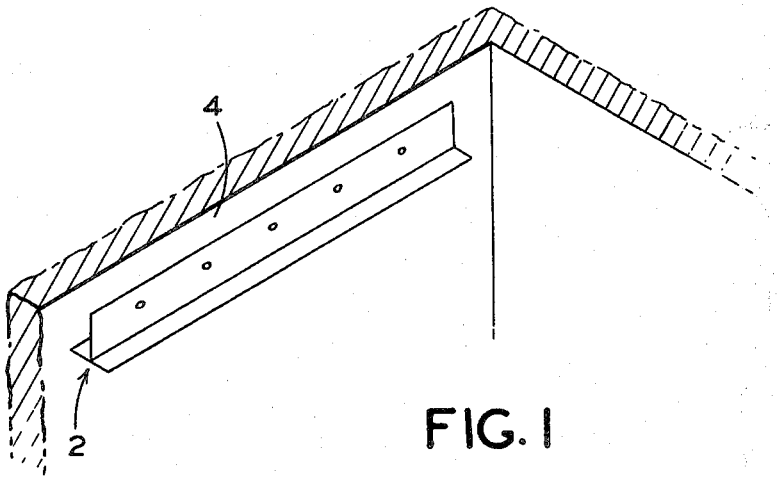
FIG. 1 is a perspective view of the invention in use.
Figure 2:
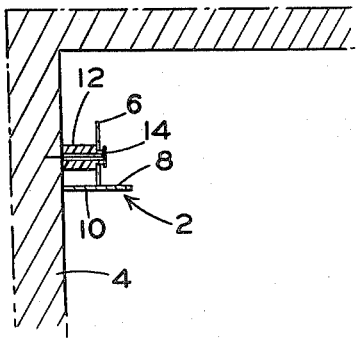
FIG. 2 is a side view of the invention in use.

The invention is shown in use in FIG. 1. Therein is shown a conventional vertical wall 4 upon which is positioned the inverted T-shaped angle molding 2 of the invention herein. FIG. 2 shows the inverted T-shaped molding 2 with a vertical flange 6 and two horizontal flanges 8 and 10. If one attempted to use a nail passing through the vertical flange 6 for the purpose of fastening the inverted T runner to the wall 4, the flange 10 would engage the wall before the vertical flange 6. Driving the nail tight against the wall would cause the vertical flange 6 to slope up against the wall and thus flanges 8 and 10 rather than being in a horizontal plane would be in an inclined plane extending between the wall and the ceiling. This would be an undesirable condition for mounting a ceiling board thereon.

Consequently, a spacer means 12 is positioned in the space between the vertical flange 6 and the wall 4. The spacer means 12 will be the same width as the width of the vertical flange 10. The nail 14 will pass through the spacer means 12 or adjacent the spacer means 12 so that the spacer means can hold the vertical flange 6 in a vertical position parallel to the wall when the nail is driven tightly against vertical flange 6 and into the wall 4.

Figure 3:
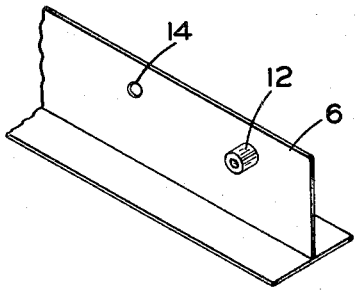
FIG. 3 is a perspective view of the inventive wall angle molding.

FIG. 3 is showing of a specific spacer means 12 which is nothing more than a plastic tube through which a nail may pass. The plastic tube 12 could be just placed up against the vertical flange 6 or the vertical flange 6 could be provided with a small aperture like aperture 14 and the spacer 12 could have a reduced diameter section which would slide into the aperture 14 and the shoulder between the reduced section and the normal diameter of spacer 12 would rest up against the vertical flange. In effect, the spacer means 12 would have a diameter larger than aperture 14 and a diameter the same size as aperture 14 so that the spacer means 12 could be frictionally held relative the vertical flange 6 of the runner structure. Of course, the invention herein is not restricted to the particular spacer shown since the spacer could be as simple as a block of wood which would have one dimension equal to the width of the flange 10 and could rest upon the flange 10. It is even conceivable that one could go to the extent of bending tabs out from the vertical flange, the tabs having a length equal to the width of the flange 10 and there would be a tab positioned by each aperture 14 so that the tab would, like the spacer 12, keep the flange in a vertical position when a nial is driven through the flange and tightly into the wall.

The particular advantage of using the inverted T-shaped wall angle is that that particular runner is the conventional runner for the main runners and cross runners used in the suspended ceiling in the area between the walls of the room. This eliminates the need for making a special L-shaped wall angle in addition to the conventional T-shaped runners for a suspended ceiling system. Consequently, a single runner structure, the inverted T-shaped runner structure, could be manufactured and it could be used not only to support the ceiling boards in the area between the two walls of a room, but could also support the boards along the walls of the room.

What is claimed is:

1. The combination of a wall and a runner means, the wall being a vertical planer surface and the runner means being composed of a vertical web which has disposed at the lower edge thereof two horizontal flanges, one extending out each side of the vertical web, said runner means being positioned adjacent the vertical wall with the vertical web of the runner means being placed parallel to the vertical wall and the horizontal flanges being placed perpendicular to the vertical wall, one edge of one of the horizontal flanges engaging the wall and that horizontal flange spacing the vertical web from the wall the width of the horizontal flange, the improvement comprising:

(a) providing the vertical web with a plurality of spaced apertures, (b) providing a spacer means with a large dimension, a small dimension, and an effective length equal to the width of a horizontal flange, (c) positioning a spacer means per aperture with the small dimension part of the spacer means inserted in the aperture and the large dimension part of the spacer means not being able to be inserted in the aperture, said spacer means extending from the vertical web to the wall its effective length, (d) the effective length of the spacer means being the length of the portion of the spacing means having the large dimension, and (e) fastening means passing through the vertical web and firmly affixing the runner means to the vertical wall so that the runner means is rigidly held in position and the horizontal flanges of the runner means are kept in a position perpendicular to the vertical wall.

* * * * *